US006554592B1

(12) United States Patent
Sun et al.

(10) Patent No.: US 6,554,592 B1
(45) Date of Patent: Apr. 29, 2003

(54) SCROLL COMPRESSOR WITH CONDITION RESPONSIVE BACK PRESSURE CHAMBER VALVE

(75) Inventors: Zili Sun, Arkadelphia, AR (US); Thomas R. Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/978,406

(22) Filed: Oct. 16, 2001

(51) Int. Cl.[7] ..... F04C 18/00
(52) U.S. Cl. ..... 418/55.5; 418/57
(58) Field of Search ..... 418/55.5, 57

(56) References Cited

U.S. PATENT DOCUMENTS 6,077,057 A * 6/2000 Hugenroth et al. ..... 418/55.5
6,146,119 A * 11/2000 Bush et al. ..... 418/55.5
6,203,299 B1 * 3/2001 Williams et al. ..... 418/55.2
6,217,302 B1 * 4/2001 Sun et al. ..... 418/55.5
6,341,945 B1 * 1/2002 Hugenroth et al. ..... 418/14

FOREIGN PATENT DOCUMENTS

JP 05001677 A * 1/1993 ..... F04C/18/02
JP 06272678 A * 9/1994 ..... F04C/18/02

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor includes first and second scroll members having wraps interfitting to define compression chambers. As is known, a back pressure chamber is defined to hold the two scroll members in contact with each other. A valve is positioned to selectively block flow of refrigerant into the back pressure chamber, but is condition responsive to change the flow of refrigerant into the back pressure chamber dependent on conditions within the compressor. In one embodiment, the valve normally blocks a second tap which communicates with discharge pressure. If an elevated temperature is reached the valve moves to an open position and refrigerant can flow from the discharge pressure chamber into the back pressure chamber. In another embodiment, the valve selectively closes a lower pressure tap.

18 Claims, 3 Drawing Sheets

SCROLL COMPRESSOR WITH CONDITION RESPONSIVE BACK PRESSURE CHAMBER VALVE

BACKGROUND OF THE INVENTION

This application relates to a scroll compressor wherein valves are selectively actuated based upon adverse conditions in a scroll compressor to change the back pressure chamber tapped fluid.

Scroll compressors are becoming widely utilized in refrigerant compression applications. In a scroll compressor a first scroll member includes a base with a generally spiral wrap extending from its base. A second scroll member has a base with a generally spiral wrap extending from its base. The wraps of the two scroll members interfit to define compression chambers. The second scroll member is caused to orbit relative to the first scroll member, and as the two wraps orbit relative to each other an entrapped refrigerant is compressed. Scroll compressors are widely utilized due to efficiency and other advantages. However, they also raise challenges to a scroll compressor designer. One challenge relates to resisting a so-called "separating force". As the refrigerant is compressed between the two relatively orbiting scroll members, a force is created by the compressed refrigerant tending to separate the two scroll members. To resist this force, compressed refrigerant is tapped to a back pressure chamber behind one of the two scroll member bases. This back pressure force resists the separating force and holds the two scroll members in contact with each other.

There are challenges with regard to providing an optimum back pressure chamber force. The back pressure chamber force which is optimum will vary with varying conditions within the compressor. There are situations wherein the compressor will be operating under adverse conditions, and it is difficult to address those conditions while at the same time providing a desirable back pressure force for normal operating conditions.

As an example, scroll compressors may sometimes operate at a high pressure ratio condition. If there is a loss of charge or an indoor fan failure, then very high pressure ratio conditions can be created. The stability of the scroll compressor is effected by the back pressure chamber force. A desired back pressure chamber force to obtain optimum stability increases as the pressure ratio increases. Thus, a desirable back pressure chamber to obtain optimum stability at normal operating ranges would be undesirably low at high pressure ratio operation.

It is thus desirable to provide a scroll compressor having a condition responsive control of the pressure in a back pressure chamber.

SUMMARY OF THE INVENTION

In the disclosed embodiment of this invention, a back pressure tap from an intermediate pressure chamber delivers an intermediate pressure fluid to a back pressure chamber in a scroll compressor. A second selective tap communicates discharge pressure chamber to the back pressure chamber. A valve is biased to close this second tap. The valve is conditioned responsive, such that if conditions within the scroll compressor indicate a higher pressure would be desirable within the back pressure chamber, the valve moves to an open position and discharge pressure refrigerant is delivered to the back pressure chamber. In one preferred embodiment, a bi-metal snap valve is utilized which is normally biased to close the second discharge pressure tap, but is movable to a position at which it allows flow from the second discharge pressure tap into the back pressure chamber when an elevated temperature is experienced in the scroll compressor.

In another embodiment, it is the intermediate pressure tap which is closed by a valve upon certain conditions. In this embodiment, the valve is normally open and allows flow into the back pressure chamber under normal conditions. However, if an elevated temperature is reached, then the valve is moved to a position at which it will block flow of at least intermediate pressure fluid to the back pressure chamber. In one embodiment, this valve will block the flow of any refrigerant into the back pressure chamber. In such condition, the back pressure chamber will quickly move to a suction pressure and the two scroll members will move out of contact with each other. This will eliminate any resultant damage which may otherwise be experienced if the scroll compressor was operated at a high pressure ratio condition. In a third embodiment the valve which selectively closes off the intermediate pressure tap only will close portions of the tap at a lower pressure range. The tap will be free to deliver refrigerant into the back pressure chamber through a portion of the orbiting cycle of the orbiting scroll associated with higher pressure refrigerant.

In sum, the present invention provides a scroll compressor wherein the pressure of refrigerant delivered to a back pressure chamber is controlled by a condition responsive valve. The invention thus allows a scroll compressor designer to ensure safe operation of the scroll compressor at a variety of extreme conditions, and across a variety of otherwise undesirable operating conditions.

These and other features of the present invention can be best understood from the following specification and drawings, the following of which is a brief description.

DETAILED DESCRIPTION OF A PREFERRED EMBODIMENT

Figure 1:
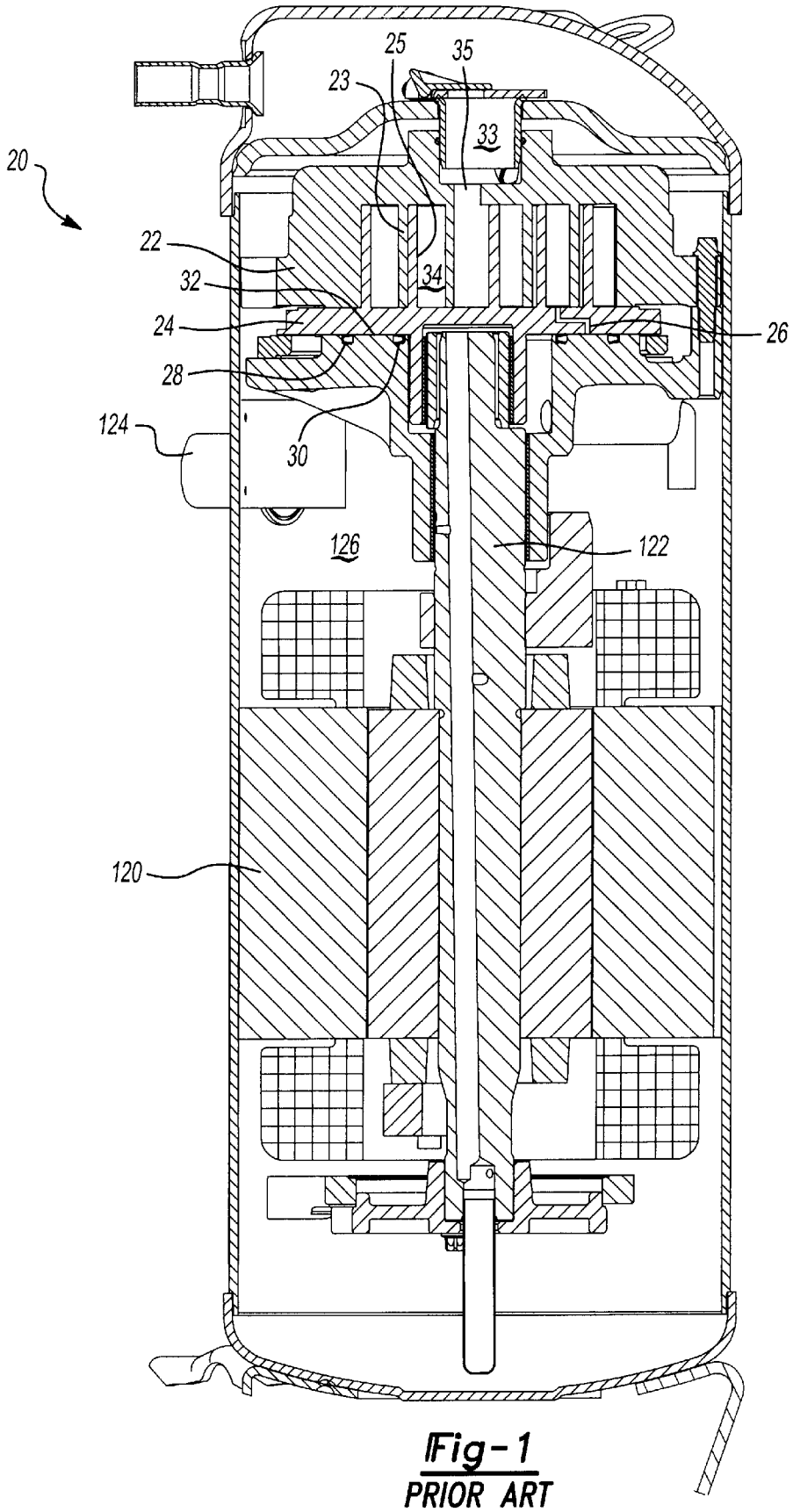
Fig-1 PRIOR ART
FIG. 1 is a cross-sectional view of a prior art compressor.

A prior scroll compressor 20 is illustrated in FIG. 1 having a non-orbiting scroll 22 with a generally spiral wrap 23. An orbiting scroll 24 has wrap 25. The wraps interfit to define compression chambers 34 as known. A tap 26 taps refrigerant from one of the compression chambers 34 to a back pressure chamber 32 defined by seals 28 and 39. While the back pressure chamber 32 is shown behind the base of the orbiting scroll 24, it should be understood that back pressure chambers are also provided behind the base of the non-orbiting scroll 22. The features of this invention would extend fully to such a scroll compressor.

One problem encountered with scroll compressors occurs at extreme operational ranges of the compressor. If a problem exists in the system, such as a lower charge of refrigerant within the refrigerant cycle than is desirable, or if another system component such as the indoor fan fails, then conditions within the scroll compressor can reach undesirable extremes. One such extreme relates to the pressure ratio, which is the ratio of the discharge pressure to the suction pressure across the compressor. If the pressure ratio increases to an undesirably high level, then there can be damage to the scroll compressor. Moreover, the scroll compressor often will operate in an unstable and noisy manner.

Scroll compressor designers attempt to select the pressure delivered to the back pressure chamber 32 in such a way that it will ideally meet the required back pressure force for the normal operating conditions of the compressor 20. However, upon certain conditions, such as high pressure ratio operation, the normal back pressure chamber force which is desirable will be too low.

As shown, a discharge pressure chamber 33 communicates with a discharge port 35 formed through the non-orbiting scroll. As is also known, a motor selectively 120 selectively drives a shaft 122 to cause the orbiting scroll 24 to orbit. The suction tube 124 delivers the suction refrigerant into a chamber 126 surrounding the motor to cool the motor.

Figure 2:
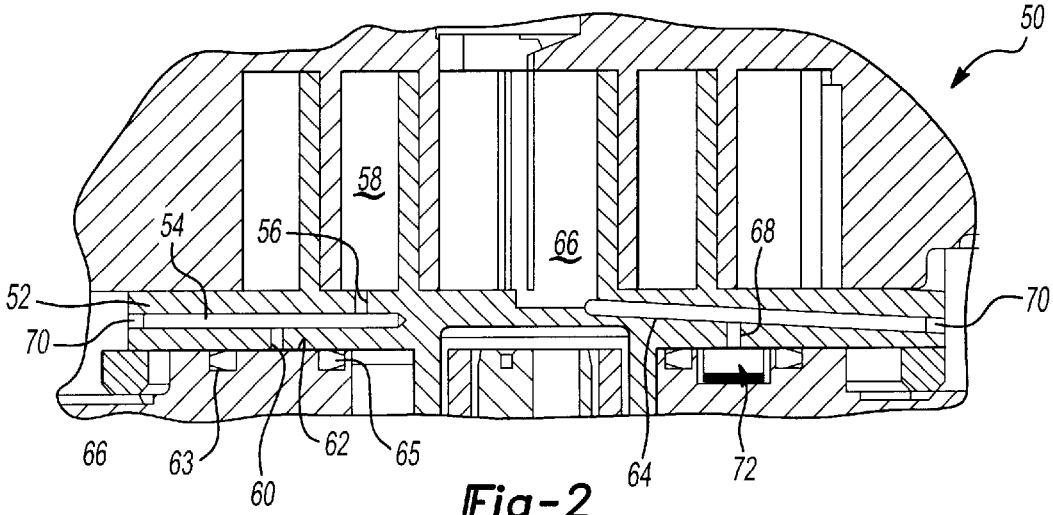
FIG. 2 is a cross-sectional view of a first embodiment of this invention.

FIG. 2 shows a first embodiment 50 of the present invention which addresses the above discussed problem. The orbiting scroll 52 in the first embodiment 50 includes the normal passage 54 communicating with a tap 56 to an intermediate pressure chamber 58. The passage 54 also communicates with a tap 60 which delivers refrigerant to a back pressure chamber 62 defined between two seals 63 and 66. As is mentioned above, while the present embodiment is illustrated with a back pressure chamber behind the orbiting scroll 52, the aspects of this invention would also apply to the type of scroll compressor having its back pressure chamber behind the non-orbiting scroll. A worker in this art would understand how to apply the goals and benefits of this invention to such a scroll compressor.

As also shown, a second passage 64 communicates with a discharge pressure chamber 66. The passage 64 communicates with the tap 68 to the back pressure chamber 62. Plugs 70 close the passages 54 and 64, as known.

A condition responsive valve 72 selectively closes the tap 68.

Figure 3A:
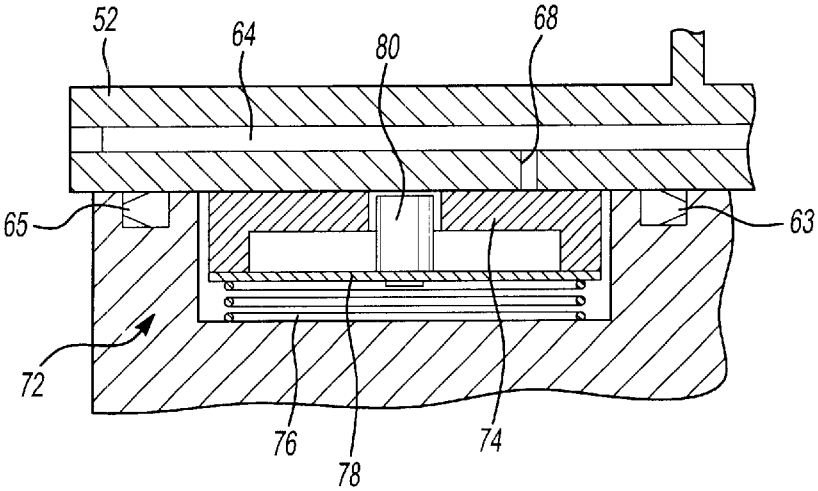
FIG. 3A shows the first embodiment in a normal state.

As shown in FIG. 3A, the valve assembly 72 includes a valve plate 74 normally spring biased 76 to a position at which it closes the tap 68. A bi-metal two-position snap member 78 is shown in its relaxed position. Member 78 is attached to plate 74. Such bi-metal elements are known, and snap between two portions when a trigger temperature is reached. The member 78 will remain in this position unless the conditions within the scroll compressor are such that the temperature adjacent to the snap member 78 increases beyond a "trigger" temperature. A pin 80 moves with the snap member 78.

Figure 3B:
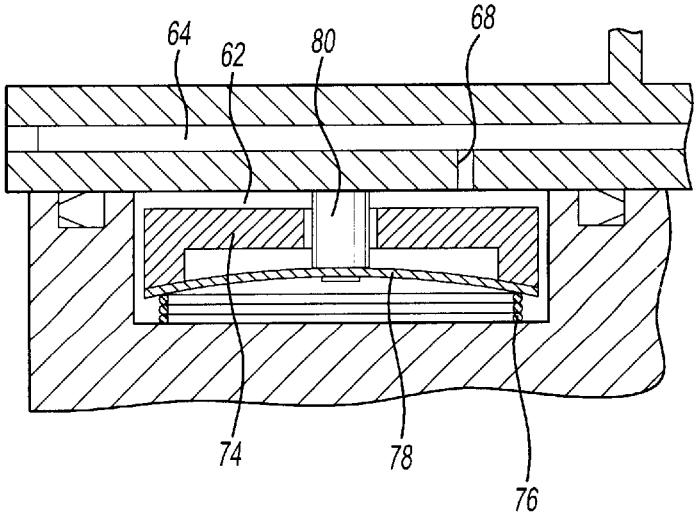
FIG. 3B shows the first embodiment in an actuated state.

As shown in FIG. 3B, conditions within the scroll compressor have changed such that the temperature has increased beyond the "trigger point" of the snap element 78. The snap element now assumes a distinct configuration from that shown in FIG. 3A. The pin 80 is now forced against the rear of the base of the orbiting scroll 52, and the plate 74 is forced away from the tap 68. In this position, refrigerant from the passage 64 which is at discharge pressure, is delivered into the back pressure chamber 62. In this way, should the conditions be indicative of a high pressure ratio operation, a higher pressure of refrigerant is delivered to the back pressure chamber. The problems discussed above are thus reduced or even eliminated.

Figure 4:
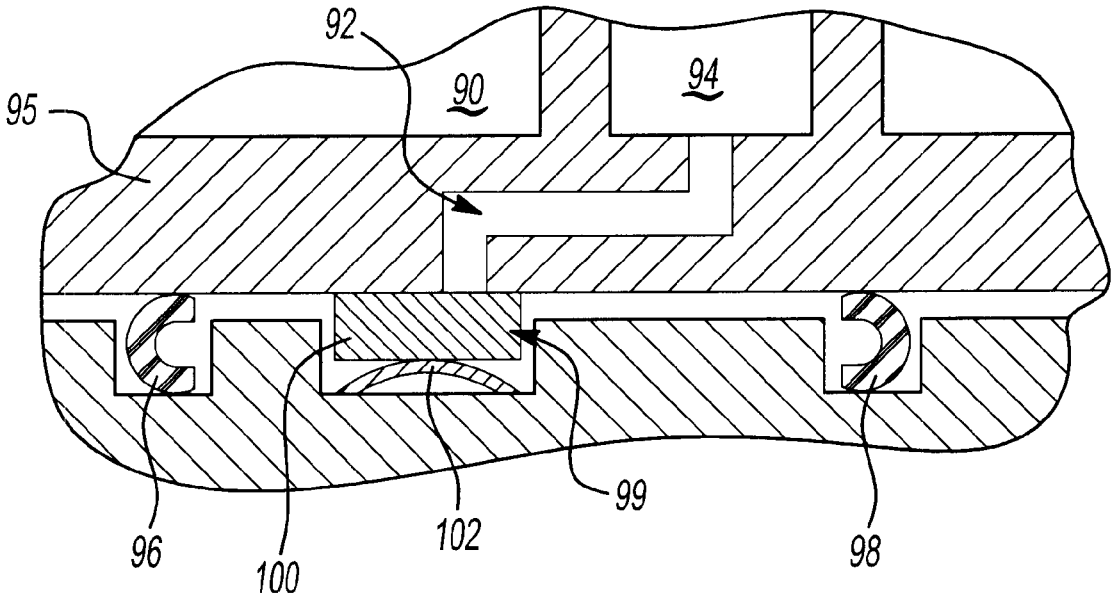
FIG. 4 shows a second embodiment.

FIG. 4 shows another embodiment 90. In embodiment 90, it is the tap 92 to the intermediate pressure chamber 94 which is selectively opened or closed by the valve element 99. Seals 96 and 98 define the back pressure chamber, as known. The valve 99 includes a valve plate member 100 which selectively closes the tap 92. The bi-metal snap member 102 is shown in a position such that it snaps to bias the valve 100 to close the tap 92 when the elevated temperature is reached. In a relaxed position, the snap element 102 would be more generally flat, and the plate 100 is moved away from the position closing the tap 92. In this position, refrigerant can flow through the tap 92 into the back pressure chamber. However, should elevated temperatures be reached, the snap member 102 will snap to the illustrated position and the valve 100 closes the tap 92.

In this embodiment, the valve 100 will close all communication with tap 92, once the condition has been reached. Eventually, refrigerant from the suction pressure chamber 126 will leak around the seals 96 and 98 such that the back pressure chamber will move to suction pressure. At that time, the orbiting scroll member 95 will be able to move away from the non-orbiting scroll member. This will also eliminate the damages discussed above in that the two scrolls will no longer be held in contact with each other, and much of the ill effect of high pressure ratio operation will be avoided. Further, this embodiment could be utilized with the type of embodiment having the discharge pressure tap which is selectively opened. That is, the FIG. 4 and 3 embodiments could be utilized in combination.

Figure 5:
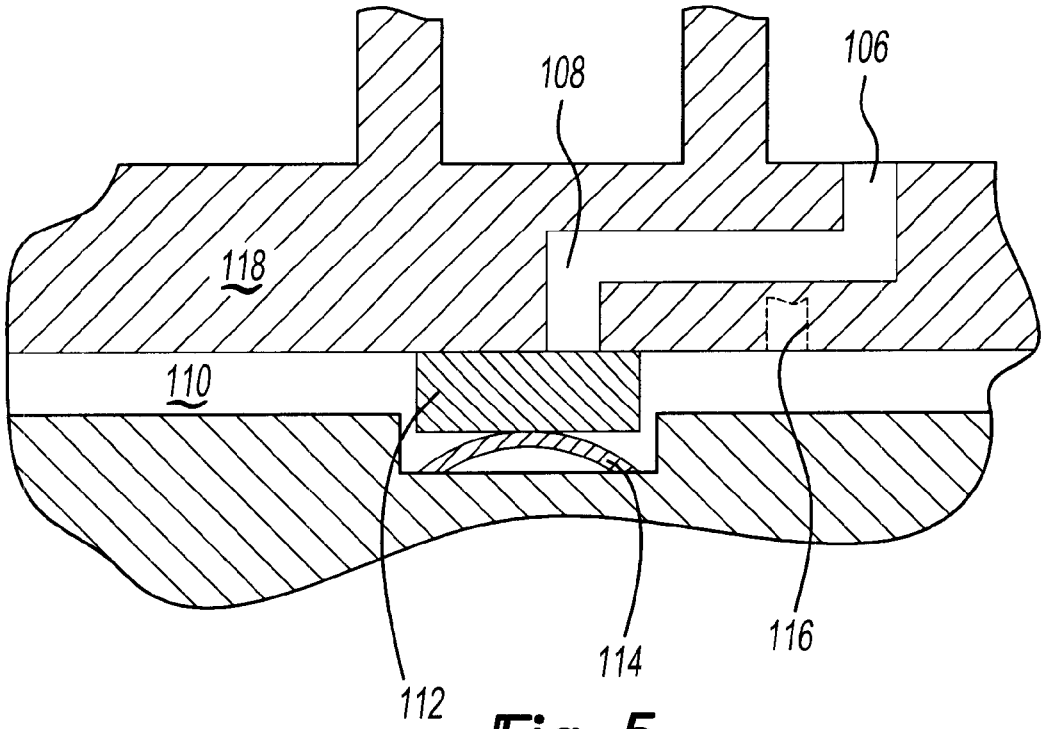
FIG. 5 shows a third embodiment.

FIG. 5 shows yet another embodiment which is similar to the FIG. 4 embodiment. However, the valve assembly 112 is positioned such that it blocks the tap 106 at positions such as shown at 108. Refrigerant at the location of the position 108 will not be delivered into the back pressure chamber 110 when the snap member 114 is moved to this actuated position. However, a second position 116 is shown in phantom at which the tap will no longer be aligned with the valve 112. It should be understood that the tap 106 will move through an orbiting cycle during the orbiting movement of the orbiting scroll 118. When the tap reaches the position 116, then refrigerant can be delivered into the back pressure chamber 110. In this way, the scroll compressor designer can eliminate lower or intermediate pressure refrigerant from entering the back pressure chamber 116, while still allowing the flow of discharge pressure refrigerant through the positions 116. This will also address the high pressure ratio operation issues in a manner similar to the FIG. 3A embodiment.

Although preferred embodiments of this invention have been disclosed, a worker in this art would recognize that many modifications would come within the scope of this invention. For that reason, the following claims should be studied to determine the true scope and content of this invention.

What is claimed is:

1. A scroll compressor comprising:

a first scroll member having a base and a generally spiral wrap extending from its base;

a second scroll member having a base and a generally spiral wrap extending from its base, said wraps of said first and second scroll members interfitting to define compression chambers;

said second scroll member being driven to orbit relative to said first scroll member to entrapped refrigerant in said compression chambers to become compressed; and a back pressure chamber defined behind a base of one of said first and second scroll members, and a tap for delivering a refrigerant to said back pressure chamber, and a condition responsive valve operable upon said compressor reaching a particular condition to change the flow of refrigerant being delivered to said back pressure chamber, said condition responsive valve being temperature responsive and said particular condition being a first elevated temperature being reached.

2. A scroll compressor as recited in claim 1, wherein said valve includes a bi-metal member which is movable between two positions, and has a trigger temperature causing it to move to an actuated position, and said valve moving to said actuated position when the trigger temperature is reached to cause said change in the flow of refrigerant to said back pressure chamber.

3. A scroll compressor as recited in claim 2, wherein said valve is normally biased to a position blocking flow through the tap, and said bi-metal element moving to its actuated position allowing refrigerant to flow from said tap into said back pressure chamber when an elevated temperature is reached.

4. A scroll compressor as recited in claim 3, wherein there are a pair of taps with said valve closing off the tap to a higher pressure location, with a first tap being normally opened and communicating with a location at a lower pressure than said first tap.

5. A scroll compressor as recited in claim 4, wherein said valve is normally spring biased to close said second tap, with said bi-metal element snapping to the actuated position causing said valve to move away from said tap and allow flow of said second higher pressure refrigerant into said back pressure chamber.

6. A scroll compressor as recited in claim 2, wherein said valve is normally held away from said tap but is movable to selectively close said tap if said bi-metal element reaches its trigger temperature.

7. A scroll compressor as recited in claim 6, wherein said valve closes said tap throughout the orbiting cycle of said second scroll member.

8. A scroll compressor as recited in claim 2, wherein said valve is positioned such that it only blocks flow of refrigerant from said tap into said back pressure chamber at lower pressure locations in an orbiting cycle of said orbiting scroll member.

9. A scroll compressor as recited in claim 1, wherein said back pressure chamber is defined behind said second scroll member.

10. A scroll compressor as recited in claim 1, wherein there are a pair of taps, with a first tap communicating with a lower pressure location in said compression chambers and a second tap communicating with a higher pressure location and there being a pair of valves with a first valve selectively moving to close said first tap when an elevated temperature is reached and a second valve selectively moving to open said second tap when said elevated temperature is reached.

11. A scroll compressor as recited in claim 1, wherein said first scroll member and at least a portion of said second scroll member being received in a suction pressure chamber.

12. A scroll compressor comprising:

a first scroll member having a base and a generally spiral wrap extending from its base;

a second scroll member having a base and a generally spiral wrap extending from its base, said wraps of said first and second scroll members interfitting to define compression chambers;

said second scroll member being driven to orbit relative to said first scroll member to entrapped refrigerant in said compression chambers to become compressed; and a pair of taps extending through one of said first and second scroll members to deliver a refrigerant into a back pressure chamber defined behind a base of one of said first and second scroll members, a first of said tap communicating with a lower pressure compression chamber, and a second of said taps communicating with the higher pressure compression chamber, a condition responsive valve selectively opening or closing said second tap, and said condition responsive valve being movable upon an elevated temperature being reached within said compressor to open said second tap.

13. A scroll compressor as recited in claim 12, wherein said taps extend through second scroll member.

14. A scroll compressor as recited in claim 13, wherein said back pressure chamber is defined behind said second scroll member.

15. A scroll compressor as recited in claim 12, wherein said valve includes a bi-metal member which is movable between two positions, and has a trigger temperature causing it to move to an actuated position, and said valve moving to said actuated position when the trigger temperature is reached to cause said change in the flow of refrigerant to said back pressure chamber.

16. A scroll compressor as recited in claim 15, wherein said valve is normally biased to a position blocking flow through the tap, and said bi-metal element moving to its actuated position allowing refrigerant to flow from said tap into said back pressure chamber when an elevated temperature is reached.

17. A scroll compressor as recited in claim 16, wherein said valve is normally spring biased to close said second tap, with said bi-metal element snapping to the actuated position causing said valve to move away from said tap and allow flow of said second higher pressure refrigerant into said back pressure chamber.

18. A scroll compressor as recited in claim 12, wherein said first scroll member and at least a portion of said second scroll member being received in a suction pressure chamber.

* * * * *

UNITED STATES PATENT AND TRADEMARK OFFICE

CERTIFICATE OF CORRECTION

PATENT NO. : 6,554,592 B1
DATED : April 29, 2003
INVENTOR(S) : Sun et al.

It is certified that error appears in the above-identified patent and that said Letters Patent is hereby corrected as shown below:

Column 6,
Line 10, of the patent, “entrapped” should be -- entrap --.
Line 16, of the patent, “tap” should be -- taps --.

Signed and Sealed this

Seventeenth Day of June, 2003

JAMES E. ROGAN
*Director of the United States Patent and Trademark Office*